US009957672B2

(12) United States Patent
Rosier

(10) Patent No.: US 9,957,672 B2
(45) Date of Patent: May 1, 2018

(54) ROADWAY TRACK WITH VERTICAL PIVOT JOINT

(71) Applicant: MUSTHANE, Willems (FR)

(72) Inventor: Reza Rosier, Dottignies (BE)

(73) Assignee: MUSTHANE, Willems (FR)

( * ) Notice: Subject to any disclaimer, the term of this patent is extended or adjusted under 35 U.S.C. 154(b) by 0 days. days.

(21) Appl. No.: 15/323,442

(22) PCT Filed: Jul. 15, 2015

(86) PCT No.: PCT/EP2015/066169
§ 371 (c)(1),
(2) Date: Jan. 3, 2017

(87) PCT Pub. No.: WO2016/008923
PCT Pub. Date: Jan. 21, 2016

(65) Prior Publication Data

US 2017/0137999 A1 May 18, 2017

(30) Foreign Application Priority Data

Jul. 15, 2014 (FR) ..... 14 56768

(51) Int. Cl.
*E01C 9/08* (2006.01)
*E01C 5/00* (2006.01)

(52) U.S. Cl.
CPC ..... *E01C 9/08* (2013.01); *E01C 5/005* (2013.01); *E01C 9/086* (2013.01); *E01C 2201/16* (2013.01)

(58) Field of Classification Search
CPC .. E01C 2201/02; E01C 2201/16; E01C 5/003; E01C 5/18; E01C 5/20; E01C 5/22; E01C 9/08; E01C 9/086; B60S 3/042
See application file for complete search history.

(56) References Cited

U.S. PATENT DOCUMENTS 1,004,861 A 10/1911 Ek
1,375,666 A 4/1921 Bauer
(Continued)

FOREIGN PATENT DOCUMENTS

DE 3122441 A1 12/1982
FR 2424138 A1 11/1979
(Continued)

OTHER PUBLICATIONS

French Preliminary Search Report dated Jul. 17, 2015, French Application No. 1461763, pp. 1-2.
(Continued)

*Primary Examiner* — Gary S Hartmann
(74) *Attorney, Agent, or Firm* — MH2 Technology Law Group, LLP

(57) ABSTRACT

A roadway track (10) for a vehicle (T) is provided, the roadway track having a roadway face and being suitable for being rolled up and designed to be placed on the ground and presenting a rolled-up position and a deployed position in which the roadway track extends substantially parallel to the ground. The roadway track includes at least a first track portion (14) and a second track portion (16), the first and second track portions being connected to each other by a pivot connection (18) having a pivot axis (A) that extends in a direction that is substantially perpendicular to the roadway face, whereby the first track portion can pivot relative to the second track portion about the pivot axis so as to form a bend (V).

15 Claims, 5 Drawing Sheets

(56) References Cited

U.S. PATENT DOCUMENTS

| | | | | |
|---|---|---|---|---|
| 1,410,055 | A | 3/1922 | Brian | |
| 1,863,316 | A | 6/1932 | Webster, Jr. | |
| 2,135,901 | A | 3/1935 | Lea | |
| 3,256,785 | A | 6/1966 | Stammbach et al. | |
| 3,425,624 | A | 2/1969 | Jacobs | |
| 3,458,884 | A | 8/1969 | Gurganious | |
| 3,701,474 | A | 10/1972 | Welz | |
| 3,918,638 | A | 11/1975 | Nelson | |
| 4,121,765 | A | 10/1978 | Fosteris | |
| 4,211,366 | A | 7/1980 | Czarnota | |
| 4,998,670 | A | 3/1991 | Peterson | |
| 5,118,542 | A * | 6/1992 | McLeod | E01C 9/08 404/35 |
| 5,119,587 | A * | 6/1992 | Waltz | E04H 17/1404 47/33 |
| 5,186,574 | A | 2/1993 | Tavares | |
| 5,204,159 | A | 4/1993 | Tan | |
| 5,282,692 | A * | 2/1994 | McLeod | E01C 9/086 404/35 |
| 5,439,171 | A * | 8/1995 | Fruend | B60B 39/12 152/208 |
| D364,837 | S | 12/1995 | Hargrove | |
| 5,538,183 | A | 7/1996 | McGee | |
| 5,862,983 | A | 1/1999 | Andrus et al. | |
| 6,089,784 | A | 7/2000 | Ardern | |
| 6,394,362 | B1 | 5/2002 | Kramr | |
| 6,652,184 | B1 | 11/2003 | Knafelc | |
| 6,696,122 | B1 | 2/2004 | Deschamps | |
| 6,722,814 | B2 * | 4/2004 | Byrne | E02D 17/10 404/35 |
| 7,162,760 | B2 | 1/2007 | Schweitzer | |
| 7,634,876 | B2 | 12/2009 | Moller | |
| D615,032 | S * | 5/2010 | Pinto | D12/608 |
| D617,263 | S | 6/2010 | Pitsolis | |
| 7,941,983 | B2 * | 5/2011 | Wheeler | E04B 2/7457 52/223.9 |
| 8,167,219 | B2 | 5/2012 | Lynn | |
| 8,215,568 | B1 | 7/2012 | Pitsolis et al. | |
| 8,231,066 | B2 | 7/2012 | McCarthy | |
| 8,448,877 | B1 | 5/2013 | Aubin | |
| 8,784,002 | B2 * | 7/2014 | Ringus | E01C 9/02 14/2.5 |
| 9,067,463 | B2 | 6/2015 | Moses | |
| 9,150,050 | B2 | 10/2015 | Lynn | |
| D764,997 | S | 8/2016 | Juchniewicz et al. | |
| D775,068 | S * | 12/2016 | Wippler | D12/608 |
| 2006/0222804 | A1 | 10/2006 | Banting | |
| 2012/0321382 | A1 * | 12/2012 | Rosier | E01C 9/086 404/35 |
| 2015/0361624 | A1 * | 12/2015 | Rosier | E01C 9/08 404/35 |
| 2016/0083926 | A1 | 3/2016 | Rosier | |
| 2017/0136817 | A1 * | 5/2017 | Rosier | B60B 39/12 |

FOREIGN PATENT DOCUMENTS

| | | | |
|---|---|---|---|
| FR | 2824088 | A1 | 10/2002 |
| FR | 2825388 | A1 | 12/2002 |
| FR | 2866908 | A1 | 9/2005 |
| FR | 2874940 | A1 | 3/2006 |
| GB | 2019792 | B | 7/1982 |
| WO | 02/066742 | A1 | 8/2002 |
| WO | 2010/134735 | A2 | 11/2010 |

OTHER PUBLICATIONS

French Preliminary Search Report dated Nov. 21, 2014, French Application No. 1452872, pp. 1-2.

* cited by examiner

ROADWAY TRACK WITH VERTICAL PIVOT JOINT

BACKGROUND OF THE DISCLOSURE

The present patent application relates to the field of roadway tracks for vehicles, in particular tracks that are disposed on the ground in temporary manner, in particular so as to facilitate moving the vehicles. By way of example, such a track may be placed on loose ground, e.g. sand, on muddy terrain, or on rough ground, so as to create an access path for vehicles.

Traditionally, such tracks are suitable for being rolled up, and they present both a rolled-up position and a deployed position in which said roadway track extends substantially parallel to the ground. Generally, such tracks are constituted by rectilinear mats placed end-to-end so as to constitute a rectilinear access path.

Such a mat is described in particular in US 2006/0222804.

When a path defining a curve or a bend is required, the mat must be curved so as to provide the desired curvature. However, sometimes that curving causes difficulties since it leads to wrinkles appearing across the mat, forming humps that hinder progress of the vehicle. The appearance of wrinkles is due to the fact that the mats are made from materials presenting considerable lateral stiffness, in particular because of their width.

OBJECT AND SUMMARY OF THE DISCLOSURE

An object of the present disclosure is to overcome the above-mentioned drawbacks by providing a roll-up roadway track for a vehicle making it possible to create bends without causing wrinkles or humps to appear.

The disclosure achieves its object by the fact that the roadway track of the disclosure comprises at least a first track portion and a second track portion, the first and second track portions extending substantially parallel to the ground when the roadway track is in the deployed position, the first and second track portions being connected to each other by a pivot connection having a pivot axis that extends in a direction that is substantially perpendicular to the roadway face when said roadway track is in the deployed position, whereby the first track portion can pivot relative to the second track portion about the pivot axis so as to form a bend.

Thus, in order to form a bend, the first track portion is caused to pivot relative to the second track portion about the pivot axis that is perpendicular to the plane of the track. The first and second track portions are thus pivoted relative to each other while remaining fastened together, which makes it very easy to deflect the path of the roadway track, while ensuring continuity of the roadway track.

Insofar as the first and second track portions are not curved, the track may be free of wrinkles.

It should therefore be understood that the connection between the first and second track portions constitutes a rotary junction about an axis perpendicular to the track.

Without going beyond the ambit of the present disclosure, the roadway track may include one or more junctions of the same type as a function of the radius of curvature and of the length of the bend it is desired to obtain.

The disclosure also makes it possible to form a continuous roadway track having a plurality of successive bends, in particular "S"-shaped bends.

According to some embodiments, the pivot connection comprises a connection element for fastening the first track portion to the second track portion so as to pivot about said pivot axis. This connection element is a hinge part that may be of cylindrical shape having the pivot axis as its axis. The connection element thus has two functions, namely holding together the first and second track portions, and guiding relative pivoting between the first and second track portions.

According to some embodiments, the pivot connection is arranged at the end of the first track portion and, possibly, at the ends both of the first track portion and of the second track portion.

In a variant, at least the first track portion presents a projection projecting towards the second track portion, and the pivot connection is situated in said projection.

According to some embodiments, the first track portion presents an inside face disposed facing an inside face of the second track portion, the two inside faces defining an overlap zone between the first and second track portions, the pivot connection being situated in said overlap zone.

According to some embodiments, the connection element is disposed in the overlap zone, for example substantially in the middle of the width of the first track portion.

The overlap zone is shaped to ensure overlapping, both when the first and second track portions are in alignment with each other, and when they are pivoted relative to each other. One advantage is ensuring continuity of the track over the entire bend.

According to some embodiments, when considered in the longitudinal direction of the first track portion, the length of the overlap when the first track portion is in alignment with the second track portion, i.e. in a non-pivoted position, lies in the range 0 to one third of the width of the track.

This overlapping makes it possible not only to ensure continuity between the first and second track portions, but also to improve the strength of the roadway track.

In order to facilitate pivoting of the first track portion relative to the second track portion, said overlap zone presents a coefficient of friction that is strictly less than that of the roadway face of the roadway track.

According to some embodiments, at least one of the inside faces of the first and second track portions defining the overlap zone comprises a layer of a slippery material, e.g. polytetrafluoroethylene (PTFE) or any other material presenting a low coefficient of friction.

According to some embodiments, the layer of slippery material surrounds the pivot connection. By way of example, said layer presents an annular shape surrounding the pivot connection, and the connection element when one is present.

In an aspect of the disclosure, the first track portion comprises a main track portion and an end portion connected to the main track portion in hinged manner, wherein the pivot connection is situated in the end portion. One advantage is to be able to incline the end portion, e.g. raise or lower it relative to the ground. One advantage is to be able to adapt the track to differences in the level of the ground.

In a variant, the end portion is connected to the main track portion by a hinge, having its hinge perpendicular to said pivot axis.

In order to improve the strength of the roadway track, the main portion and the end portion of the first track portion include reinforcing elements that extend transversely relative to the longitudinal direction of the first track portion. The reinforcing elements thus have in particular the function of reinforcing the junction constituted by the first and second track portions.

In order to enable the track to be rolled up, the main track portion and the end portion are flexible about an axis that is transverse to the longitudinal direction of the first track portion.

It should also be understood that the first and second track portions may be flexible in order to enable the roadway track to be rolled up.

According to some embodiments, at least the end portion, and possibly the main track portion, is constituted by a textile covered in a polymer layer.

The disclosure also provides a junction for a vehicle roadway track of the disclosure, wherein said junction comprises:

a first portion; and a second portion connected to the first portion so as to pivot by means of a pivot connection;

the first portion including a mounting member in order to mount a main track portion on said first portion.

The mounting member thus makes it possible to connect the track portion to the second portion. By way of example, it may be a hinge connection.

The first portion may cover the second portion in part in an overlap zone, the pivot connection being situated in said overlap zone.

According to some embodiments, at least one of the first and second portions is made of a flexible material, for example, a textile covered in a polymer layer.

BRIEF DESCRIPTION OF THE DRAWINGS

The disclosure can be better understood on reading the detailed description given below by way of indicative and non-limiting example and with reference to the accompanying drawings, in which.

DETAILED DESCRIPTION OF THE DISCLOSURE

Figure 1:
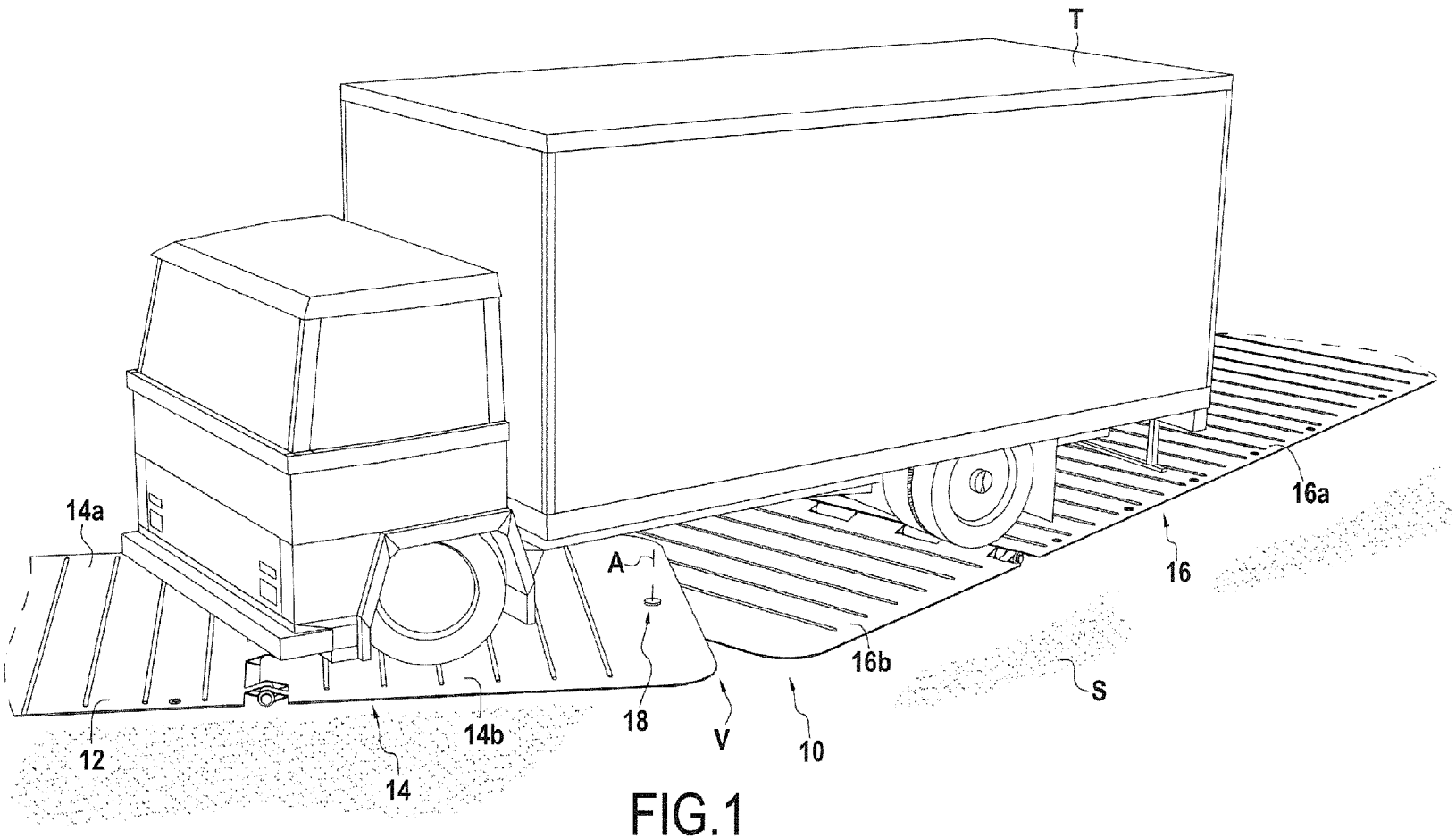
FIG. 1 shows a roadway track of the disclosure in a deployed position and forming a bend.

FIG. 1 shows an embodiment of a roadway track 10 constituting the present disclosure. This roadway track 10 is designed to enable a vehicle T to move on soft ground. In this example, the ground is sandy.

Figure 2:
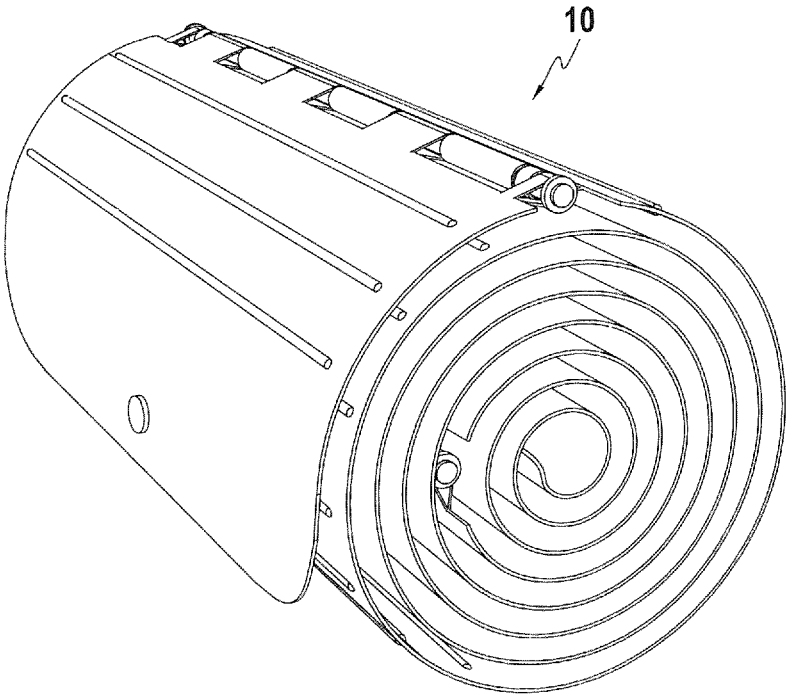
FIG. 2 shows the roadway track of FIG. 2 in a rolled-up position.

In FIG. 1, the roadway track 10 is in its deployed position, its roadway face 12 being defined as being the face that is oriented upwards. In FIG. 2, the roadway track 20 is in its rolled-up position.

As can be seen in FIG. 1, in its deployed position, the roadway track 10 extends substantially parallel to the ground S.

In accordance with the disclosure, the roadway track 10 comprises at least a first track portion 14 and a second track portion 16, the first and second track portions extending substantially parallel to the ground S when the roadway track 10 is in the deployed position.

The first and second track portions 14, 16 are connected to each other by a pivot connection 18 having a pivot axis A that extends in a direction substantially perpendicular to the roadway face when said roadway track is in the deployed position.

As can be understood from FIG. 1, the first track portion 14 may pivot relative to the second track portion 16 about the pivot axis A so as to form a bend V.

Figure 3:
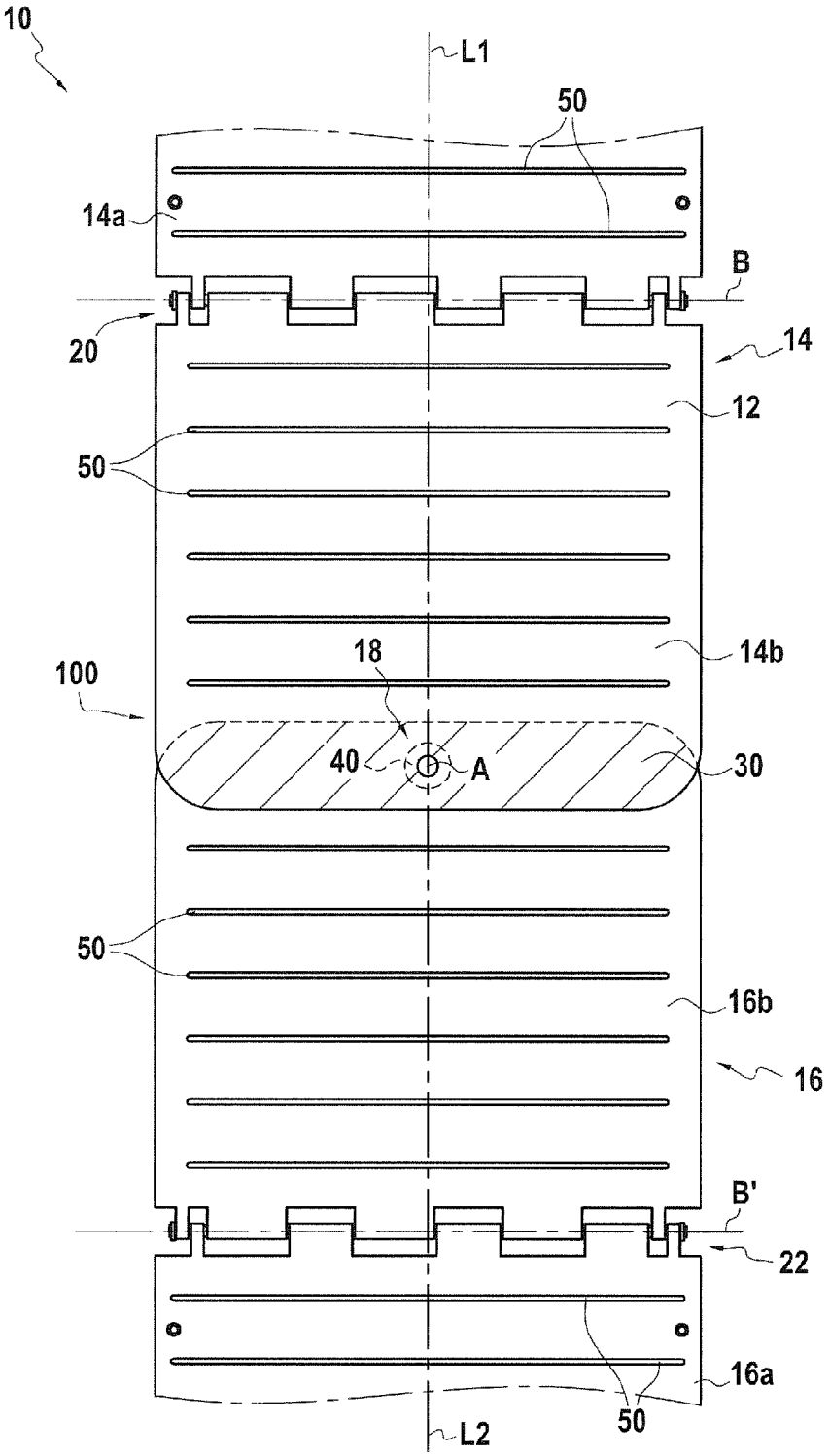
FIG. 3 is a plan view of the junction of the roadway track of FIG. 1, the first and second track portions being in alignment relative to each other.

With reference to FIG. 3, it should be observed that the first track portion 14 comprises a main track portion 14*a* and an end portion 14*b* that is connected to the main track portion in such a manner as to hinge it by means of a hinge 20 having its hinge axis B perpendicular to the pivot axis A of the pivot connection 18.

In this non-limiting example, the second track portion presents a structure that is similar to the first track portion, i.e. the second track portion comprises a main track portion 16*a* together with an end portion 16*b*, the end portion 16*b* being connected to the main track portion 16*a* in hinged manner by means of a hinge 22 having its hinge axis B' likewise perpendicular to the pivot axis A.

It should be understood that the hinges 20 and 22 have the function of inclining the main track portions 14*a* and 16*a* relative to the end portions 14*b* and 16*b* about axes of rotation that are substantially parallel to the ground, and do so in order to adapt to the topography of the ground.

It can be seen in FIG. 3 that the first track portion 14 and the second track portion 16 overlap at the pivot connection 18. More precisely, in this example, the end portion 14*b* of the first track portion 14 overlaps the end portion 16*b* of the second track portion 16. The overlap zone 30 is shown in the form of hatching in FIG. 3. There is therefore continuity between the first and second track portions when the track is rectilinear.

In FIG. 3, it should be observed that the longitudinal direction L1 of the first track portion 14 is in alignment with the longitudinal direction L2 of the second track portion 16.

Figure 4:
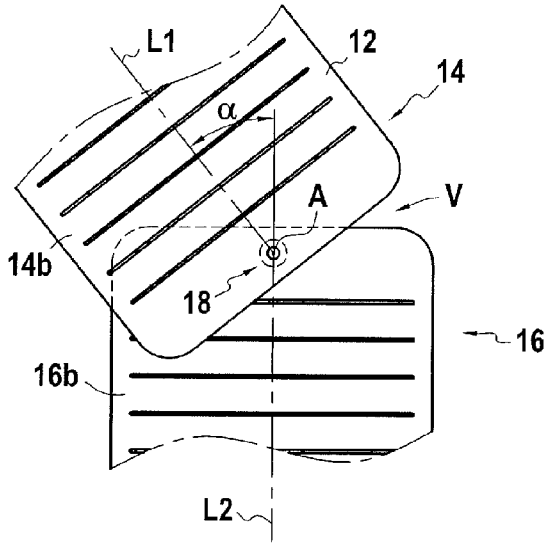
FIG. 4 shows the roadway track of FIG. 3, when the first and second track portions are pivoted relative to each other.

In FIG. 4, the first track portion 14 has pivoted relative to the second track portion about the pivot axis A through an angle $\alpha$ so as to form a bend V.

In the pivoted position of FIG. 4, it should be observed that the first and second track portions 14, 16 continue to overlap, the pivot connection 18 remaining in the overlap zone. There is thus still continuity between the first and second track portions when the first track portion has pivoted relative to the second track portion.

Figure 5:
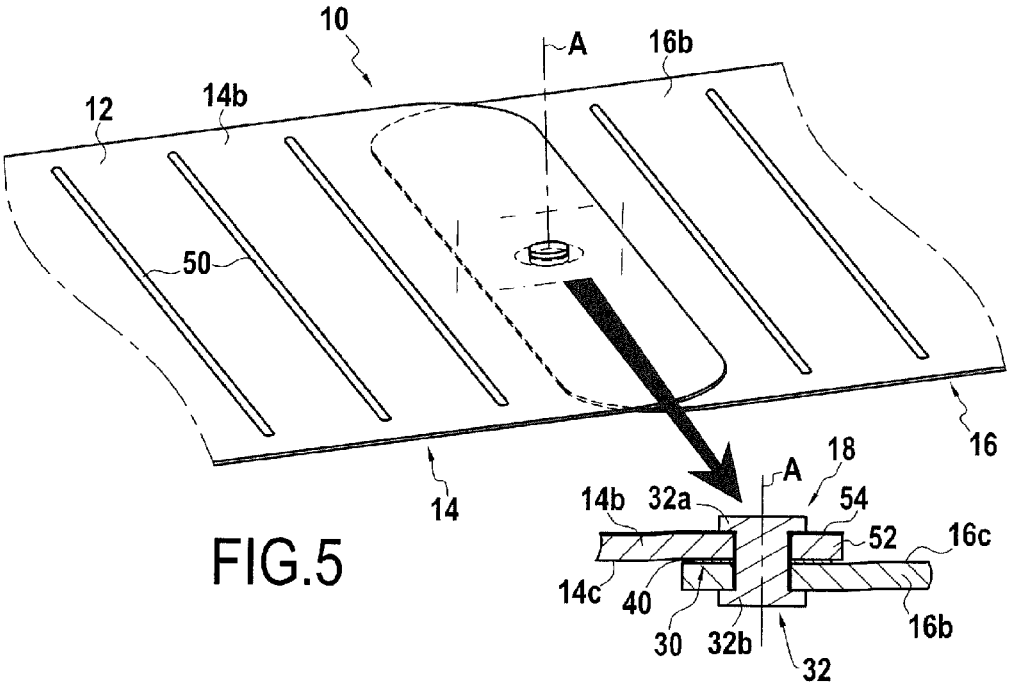
FIG. 5 is a view of a detail of the pivot connection between the first and second track portions.

With reference to FIG. 5, the pivot connection 18 is described in greater detail below.

In this example, the pivot connection 18 comprises a connection element 32 in the form of a cylinder of axis A, which has the function of fastening the first track portion 14 to the second track portion 16 to pivot about the pivot axis A. The connection element thus holds together the first and second track portions, while enabling them to pivot relative to each other.

As can be understood from FIG. 5, the end portions 14*b* and 16*b* of the first and second track portions include two coaxial orifices in which the connection element 32 is engaged. The element 32 is blocked axially relative to the end portions 14*b*, 16*b* of the first and second track portions 14, 16 by shoulders 32*a* and 32*b* that sandwich the end portions 14*b* and 16*b* at the overlap zone 30.

In addition, the first track portion 14, and more precisely the end portion 14*b* of said first track portion 14, presents an inside face 14*c* that is disposed facing an inside face 16*c* of the second track portion, both facing inside faces defining the overlap zone 30.

According to some embodiments, the overlap zone 30 presents a coefficient of friction that is strictly less than that of the roadway face 12 of the roadway track 10. For this purpose, at least one of the inside faces 14*c*, 16*c* of the first and second track portions 14, 16 defining the overlap zone 30 comprises a layer 40 of a slippery material. In this example, the slippery material is PTFE. The advantage of the slippery material (i.e., material having a low coefficient of friction) is that is facilitates pivoting of the first track portion relative to the second track portion.

In this example, the layer of slippery material 40 surrounds the pivot connection while being of annular shape, as shown in particular in FIG. 3.

In order to improve the transverse stiffness of the roadway track 10, the main portion 14*a* and the end portion 14*b* of the first track portion include reinforcing elements 50 that extend transversely relative to the longitudinal direction L1 of the first track portion. By way of example, these reinforcing elements 50 are metal rods. In this example, the main portion 16*a* and the end portion 16*b* of the second track portion 16 also include such transverse reinforcing elements 50.

According to some embodiments, the main track portion 14*a* and the end portion 14*b* are made of a material that is flexible about an axis transverse to the longitudinal direction L1 of the first track portion. In this example, the flexible material is a textile 52 covered in a polymer layer 54. This flexibility about an axis transverse to the longitudinal direction makes it possible for the track portion 10 to be rolled up. As indicated above, the rolled-up position of the roadway track 10 is shown in FIG. 2.

Figure 6:
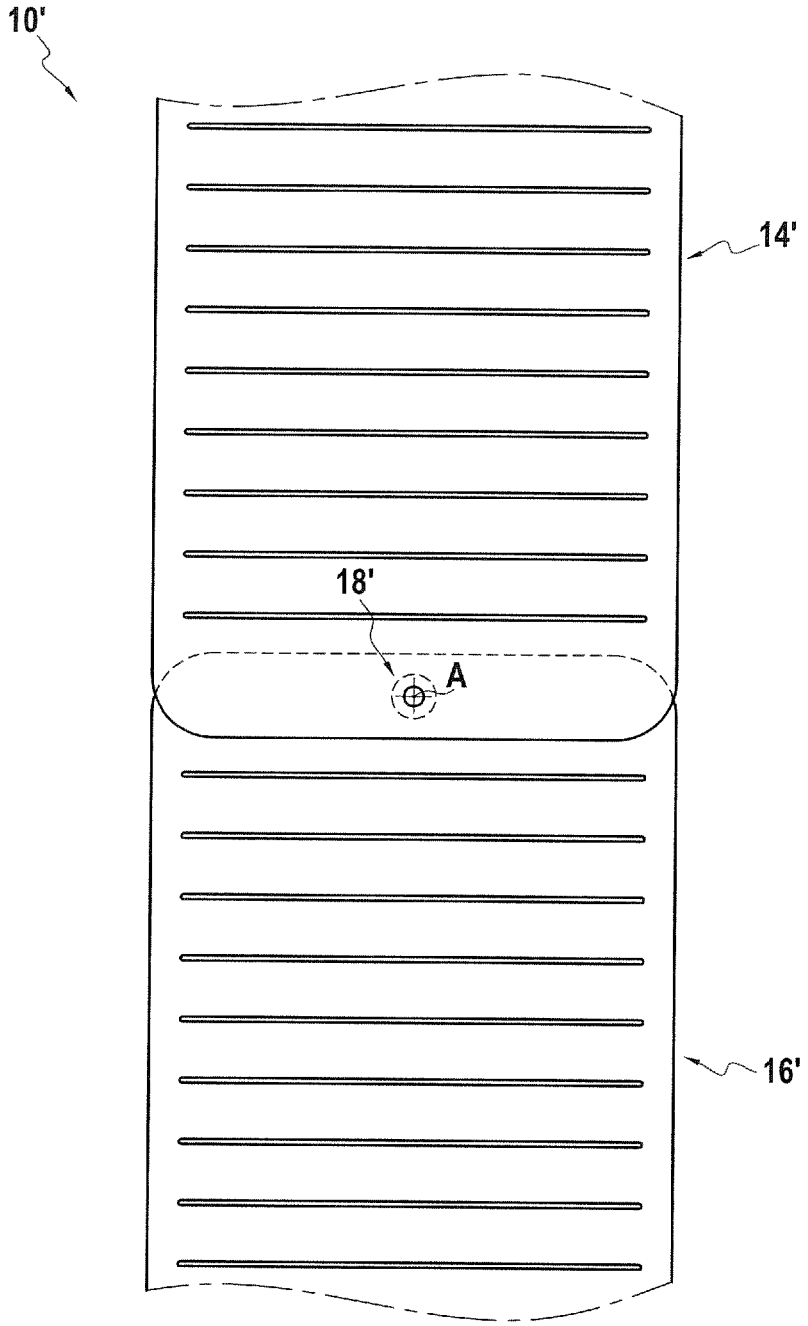
FIG. 6 shows a variant of the roadway track of FIG. 1.

FIG. 6 shows a variant embodiment of the roadway track 10' of the disclosure, which differs from the roadway track of FIG. 3, by the fact that it does not have hinges 20, 22. In this variant, for each of the first and second track portions 14', 16', the main track portion forms a single part with the end portion. Again, the first and second track portions are pivotally fastened together so as to pivot by means of the pivot connection 18'.

Again with reference to FIG. 3, it should be observed that the roadway track 10 may be defined as including a junction 100 that comprises a first portion, constituted by the end portion 14*b* of the first track portion, and a second portion constituted by the end portion 16*b* of the second track portion, connected to the first portion so as to pivot by means of the pivot connection 18 having the axis A as its pivot axis. The first portion 14*b* includes a mounting member 20, specifically the hinge connection 20, in order to mount a main track portion 14*a* on said second portion 16.

The invention claimed is:

1. A roadway track for a vehicle, comprising:

a roadway face, wherein the roadway track is configured to be rolled-up and placed on a ground, and wherein the roadway track presents a rolled-up position and a deployed position in which said roadway track extends substantially parallel to the ground;

at least a first track portion; and a second track portion, the first and second track portions extending substantially parallel to the ground when the roadway track is in the deployed position, the first and second track portions being connected to each other by a pivot connection having a pivot axis that extends in a direction substantially perpendicular to the roadway face when said roadway track is in the deployed position, such that the first track portion can pivot, during use, relative to the second track portion about the pivot axis to form a bend.

2. The roadway track according to claim 1, wherein the pivot connection comprises a connection element for fastening the first track portion to the second track portion so as to pivot about said pivot axis.

3. The roadway track according to claim 1, wherein the first track portion comprises an inside face disposed facing an inside face of the second track portion, the two inside faces defining an overlap zone between the first and second track portions, the pivot connection being situated in said overlap zone.

4. The roadway track according to claim 3, wherein said overlap zone presents a coefficient of friction that is less than that of the roadway face of the roadway track.

5. The roadway track according to claim 3, wherein at least one of the inside faces of the first and second track portions defining the overlap zone comprises a layer of a material having a low coefficient of friction.

6. The roadway track according to claim 5, wherein the layer of material having a low coefficient of friction surrounds the pivot connection.

7. The roadway track according to claim 1, wherein the first track portion comprises a main track portion and an end portion connected to the main track portion in a hinged manner, and wherein the pivot connection is situated in the end portion.

8. The roadway track according to claim 7, wherein the end portion is connected to the main track portion by a hinge, the hinge having a hinge axis perpendicular to said pivot axis.

9. The roadway track according to claim 7, wherein the main portion and the end portion of the first track portion include reinforcing elements that extend transversely relative to the longitudinal direction of the first track portion.

10. The roadway track according to claim 7, wherein the main track portion and the end portion are flexible about an axis that is transverse to the longitudinal direction of the first track portion.

11. The roadway track according to claim 7, wherein at least the end portion, and/or the main track portion comprise a textile covered in a polymer layer.

12. A junction for a vehicle roadway track according to claim 1, wherein said junction comprises:

a first portion; and a second portion connected to the first portion so as to pivot at a pivot connection;

the first portion including a mounting member to mount a main track portion on said first portion.

13. The junction according to claim 12, wherein the first portion covers the second portion at least in part in an overlap zone, the pivot connection being situated in said overlap zone.

14. The junction according to claim 12, wherein at least one of the first and second portions is made of a flexible material.

15. The junction according to claim 14, wherein the flexible material comprises a textile covered in a polymer layer.

* * * * *